United States Patent [19]

Ando et al.

[11] Patent Number: 4,645,912

[45] Date of Patent: Feb. 24, 1987

[54] PIPELINE HEATED BY A DIAGONAL FEEDING, BAND-FORM, ELECTRICAL HEAT-GENERATING APPARATUS

[75] Inventors: Masao Ando, Yokohamashi; Akito Iwasaki, Chibashi, both of Japan

[73] Assignee: Chisso Engineering Company Ltd., Tokyo, Japan

[21] Appl. No.: 588,309

[22] Filed: Mar. 12, 1984

[30] Foreign Application Priority Data

| | | | |
|---|---|---|---|
| Mar. 16, 1983 | [JP] | Japan | 58-43597 |
| Jun. 23, 1983 | [JP] | Japan | 58-113438 |
| Jul. 14, 1983 | [JP] | Japan | 58-128669 |

[51] Int. Cl.[4] ..... H05B 3/08

[52] U.S. Cl. ..... 219/541; 219/535; 219/537; 219/497; 338/295; 338/320

[58] Field of Search ..... 219/300, 301, 528, 535, 219/541, 543, 549, 553, 22 R, 22 SD, 195, 472, 475, 476, 477, 480, 497, 506; 338/214, 295, 319, 320

[56] References Cited

U.S. PATENT DOCUMENTS

| | | | |
|---|---|---|---|
| 3,221,145 | 11/1965 | Hager, Jr. | 219/528 X |
| 3,448,246 | 6/1969 | Armbruster | 219/528 |
| 3,524,966 | 8/1970 | Ando | 219/300 |
| 3,535,494 | 10/1970 | Armbruster | 219/528 |
| 3,571,561 | 3/1971 | Ando | 219/300 |
| 3,780,250 | 12/1973 | Ando | 219/10.49 |
| 3,784,785 | 1/1974 | Noland | 219/301 |
| 3,792,232 | 2/1974 | Zarenko | 219/522 |
| 4,017,715 | 4/1977 | Whitney et al. | 219/553 |
| 4,031,356 | 6/1977 | Nübe | 219/528 X |
| 4,228,418 | 10/1980 | Piedmont et al. | 338/320 X |
| 4,272,471 | 6/1981 | Walker | 219/553 X |
| 4,436,986 | 3/1984 | Carlson | 219/505 |

FOREIGN PATENT DOCUMENTS

| | | |
|---|---|---|
| 293563 | 10/1971 | Austria . |
| 373827 | 1/1964 | Switzerland . |
| 1383162 | 2/1975 | United Kingdom . |
| 2098438 | 11/1982 | United Kingdom . |

*Primary Examiner*—C. L. Albritton

*Attorney, Agent, or Firm*—Fred Philpitt

[57] ABSTRACT

A band-form, electrically heat-generating apparatus having two parallel electrodes and resistance elements intervened therebetween over the entire length of the electrodes, and connected to both the electrodes in parallel and individual feeding points on each of the respective electrodes, which apparatus is characterized in that the feeding point to one of the electrodes and that to another of the electrodes are located at diagonal positions relative to the parallelogram formed by the two electrodes and the outermost two of the resistance elements to form a heat-generating unit. A plurality of such a heat-generating apparatus may be formed by connecting such a heat-generating unit in series to form a heat-generating apparatus; and the electrically heat-generating apparatus may further be provided with a circuit for detecting or protecting voltage abnormalities. With the above apparatus, a more uniform heat generation is possible as compared with conventional apparatus.

10 Claims, 15 Drawing Figures

PIPELINE HEATED BY A DIAGONAL FEEDING, BAND-FORM, ELECTRICAL HEAT-GENERATING APPARATUS

BACKGROUND OF THE INVENTION

This invention relates to an improved electricity-feeding system for heating tape or heating cable and its applications.

Band-form, electrically heat-generating apparatus, which is essentially composed of two parallel electrodes and resistance elements intervened therebetween over the entire length of the electrodes and connected thereto in parallel has already been known as heating tape or heating cable (such heating tape or cable will hereinafter be collectively referred to as "heating tape"). Concretely the heat-generating apparatus is constructed, for example, as follows: a number of thin wires as resistance wires are connected in parallel and in a dispersed manner to two parallel electrodes over the entire length thereof, or a composition comprising powder of e.g. carbon, graphite, metals, etc. as resistance materials are filled between two electrodes, followed by covering the whole with an electrically insulating material such as plastics. Usually a voltage of several hundred volts has been impressed between the electrodes to cause the above resistance wires, etc. to generate heat. This has been utilized for preventing the freeze of water pipe, the temperature-maintenance of pipe lines, etc.

Referring to the drawings, the prior art and the present invention will be described.

Figure 5:
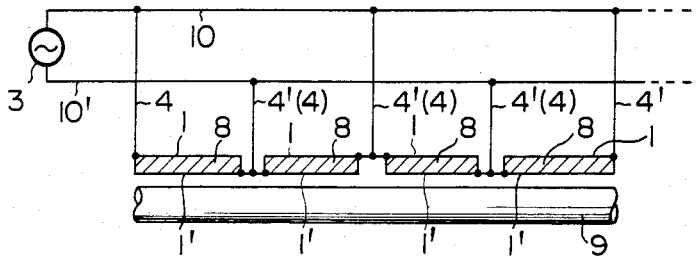
Figure 6:
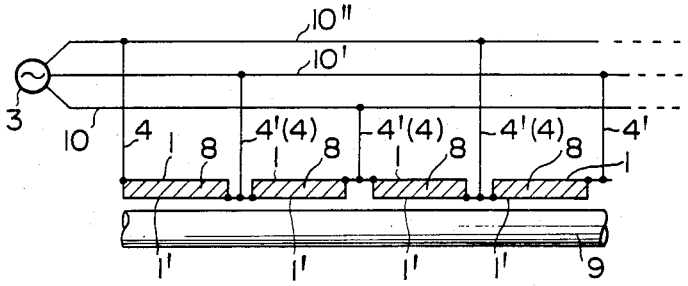

FIGS. 5 and 6 each illustrate embodiments of wire connections in the case where the heating tapes of the present invention are practically used.

Figure 7:
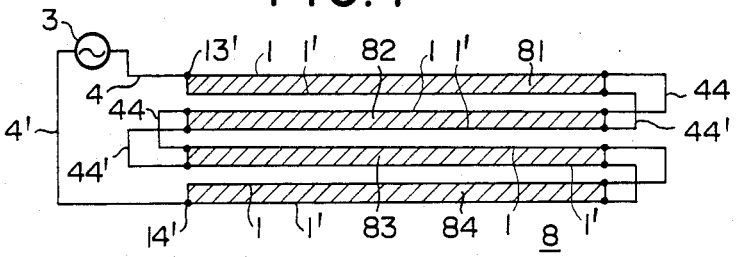

FIG. 7 shows a circuit view of an embodiment of the heating tape of the present invention.

Figure 8:
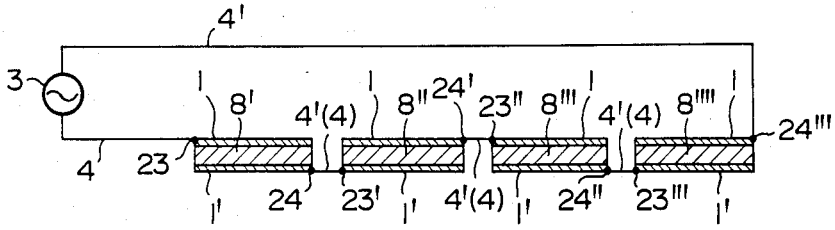
Figure 9:
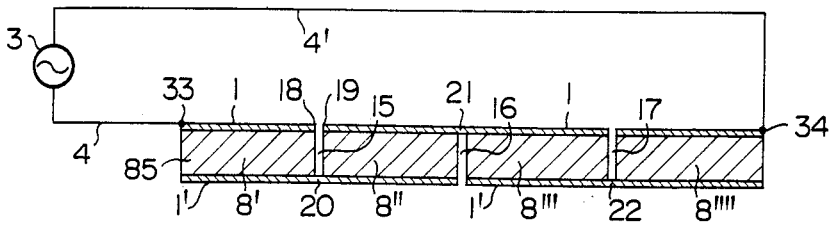
Figure 10:
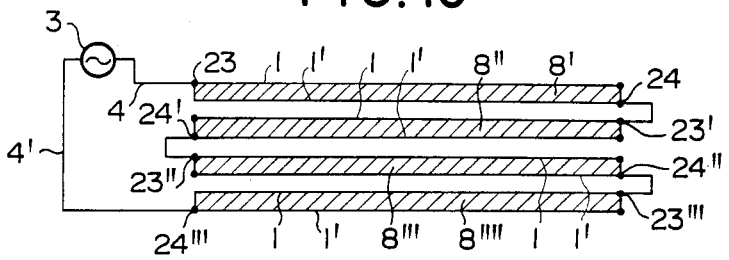

FIGS. 8, 9 and 10 each show a circuit of a combined band-form, electrically heat-generating apparatus composed essentially of combined heat-generating tape units of the present invention.

Figure 11:
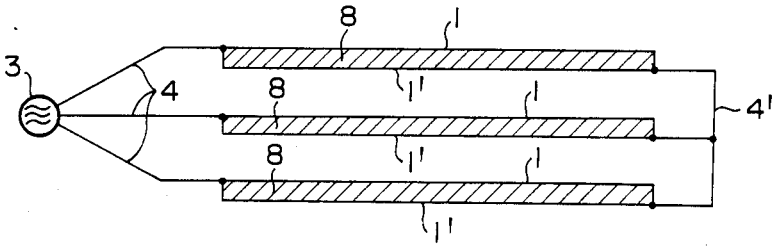
Figure 12:
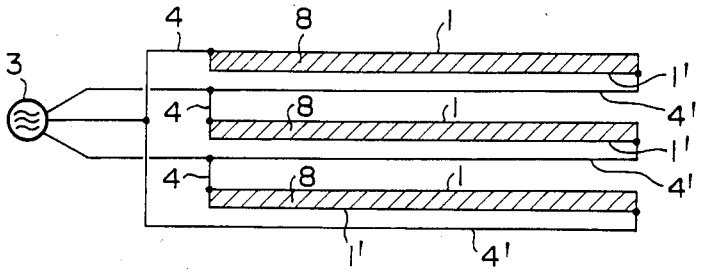

FIGS. 11 and 12 each show a view of an example of wire connections in the case where electricity is fed to a band-form, electrically heat-generating apparatus of the present invention from a three-phase electric source.

Figure 13:
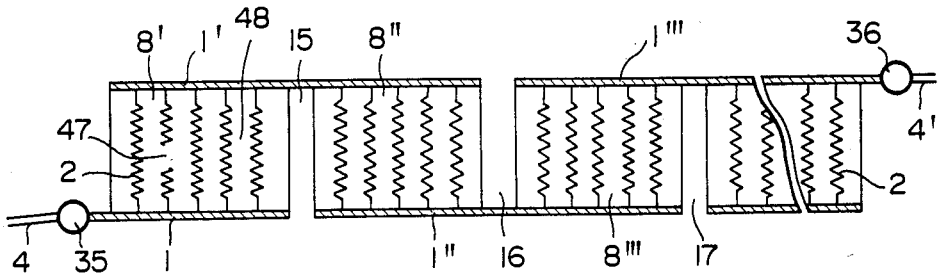

FIG. 13 shows a circuit in the case where one of the heat-generating tape units in a combined band-form, electrically heat-generating apparatus of the present invention as shown in FIG. 8, received a damage or caused a breaking of wire.

Figure 14:
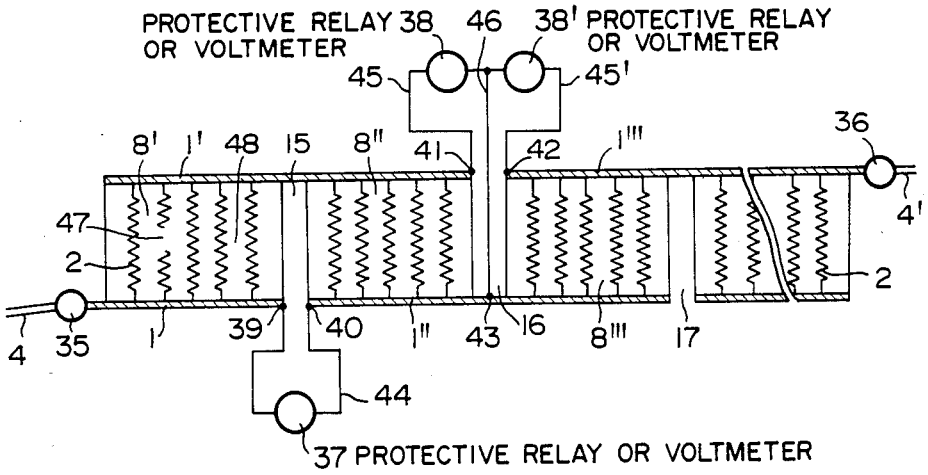

FIG. 14 shows a circuit of a band-form, electrically heat-generating apparatus of the present invention composed essentially of the apparatus shown in FIG. 13 and protective relay provided therein.

Figure 15:
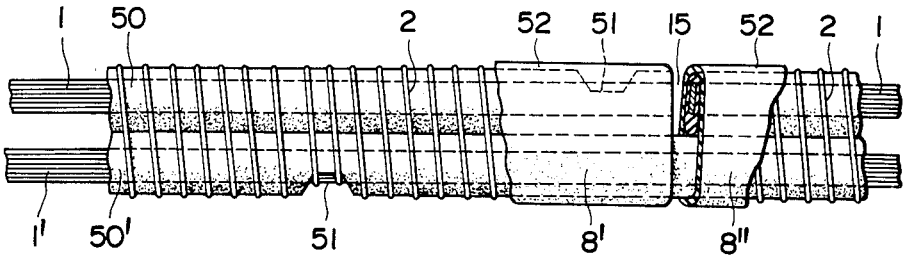

FIG. 15 shows a partial cross-sectional view of one embodiment of a band-form electrical heat generating unit according to the present invention.

Figure 1:
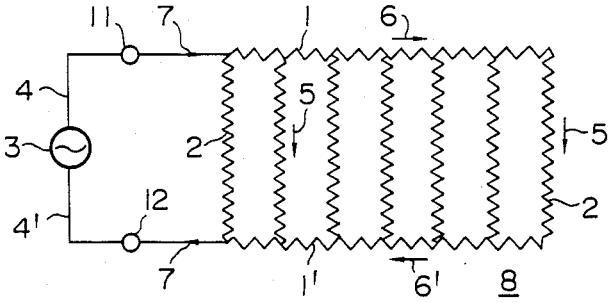
FIG. 1 PRIOR ART
FIG. 1 shows a view illustrating the circuit in principle, of a conventional heating tape.

FIG. 1 shows a circuit in principle, of the electricity-feeding system of a conventional heating tape. In this figure, numerals 1, 1' show two electrodes and are usually constructed by copper twisted wires. Since this figure shows the case of a single phase, the number of electrodes 1, 1' are two. The cross-sectional area of these electrodes is usually in the range of 1 to 5 $mm^2$. The length of the electrodes and hence the length of the tape are usually up to several tens meters. Numeral 2 represents resistance elements intervened between parallel electrodes 1, 1' over the entire length thereof and connected thereto in parallel. The interval between these electrodes 1, 1' is usually in the range of several mm to several cm. Further, in order to prevent the danger of leak, they are totally covered by a heat-resistant plastic or the like (not shown), to construct a heating tape 8. The electrodes 1, 1' are connected to an electric source 3 by lead wires 4, 4' from terminals 11, 12 provided on the same sides relative to the direction of length of the band-form, heat-generating body 8, and current 5 flows through the resistance elements 2.

Such a tape is usually used over a length of several m to several tens m and the heat generated per meter is in the range of several to several tens watts.

For example, in order to prevent service water pipe at home from freezing, the tape is bound around the service water pipe, the resulting pipe is further covered by a heat-insulating layer and the tape is then connected to an electric source.

Recently, such a heating tape has come to be used for industrial purposes e.g. for heating and temperature-maintenance of substances such as high viscosity crude oils, heavy oils, etc. which are difficult to transport through pipe due to their high viscosity at normal temperatures, to raise their temperature, lower their viscosity and transport them by pipeline. In this case, the length of the pipe may amount to several hundreds m to several thousands m unlike the length in the case of service water pipe at home.

In FIG. 1, the electrodes 1, 1' are constructed by copper twisted wires, having an electric resistance; hence, as is apparent from FIG. 1, with the increase in the length of the tape, on the remote side from the terminals 11, 12, the voltage between the electrodes gradually lowers, current 5 flowing through resistance elements 2 is reduced, and heat generation is reduced. Thus a uniform temperature-maintenance of the pipeline becomes difficult.

Figure 3:
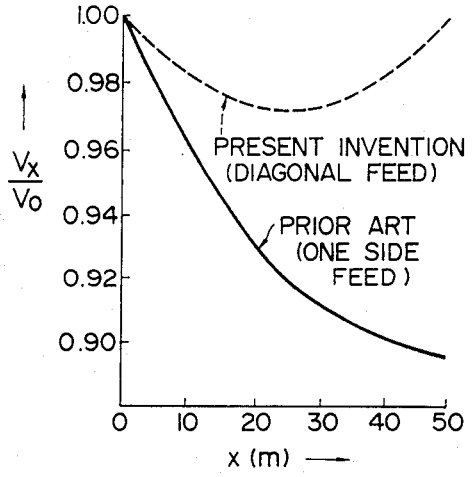
FIGS. 3 and 4 show the voltage characteristics and the electric power characteristics of the known heating tape of FIG. 1 (solid line) and the heating tape of the present invention of FIG. 2 (dotted line), respectively.

For example, in the case where there is employed a heating tape having as electrodes, copper twisted wires of about 1.2 mm in the cross-sectional area, a heat-generating power of about 20 W per m at a voltage of an electric source of 100 V and a length of 50 m, and electricity is supplied to the heating tape in the circuit as shown in FIG. 1, then a voltage between the electrodes of 100 V on the electric source side is reduced down to lower than 90 V at its remote end 50 m apart from the electric source, as shown by solid line in FIG. 3, and if the generated heat is to be maintained at 20 W/m at the remote end 50 m apart therefrom, the generated heat on the electric sourceside becomes 30 W/m; hence the difference between these heat generations amounts to 50% or higher.

In order to overcome such an unevenness in the heat generations and level them, there has been developed a heating tape having a self-controllability of heat generation (i.e. characteristics that with the increase in temperature, the electric resistance suddenly increases in the vicinity of a definite temperature to thereby reduce the input i.e. the quantity of heat generation). However, even such a heating tape is still insufficient since only a slight control i.e. levelling of heat generation is carried out.

Alternatively there is a measure of increasing the cross-sectional area of electrodes 1, 1' consisting of copper twisted wires to thereby reduce the electrode resistance, but the increase in the cross-sectional area reduces the flexibility of the heating tape to thereby damage the workability of binding the heating tape around bodies to be heated, e.g. pipeline, valves, etc. Thus, there is no other means than reduction in the length of the heating tape per one unit to thereby level the uniformity of heat generation.

A first object of the present invention is to provide an improved band-form, electrically heat-generating apparatus which has been freed from the unevenness of heat-generation in the direction of length of conventional heating tapes, without notably varying the structure of the heating tapes.

A second object of the present invention is to provide a more complete belt-form, electrically heat-generating apparatus having overcome such an intrinsic, technical defect of the heating tape thus improved.

Other objects of the present invention will be understood from explanation mentioned hereinafter.

SUMMARY OF THE INVENTION

The present invention resides in:

(1) In a band-form, electrically heat-generating apparatus having two parallel electrodes and resistance elements intervened therebetween over the entire length of the electrodes, and connected to both the electrodes in parallel and individual feeding point terminals to the respective electrodes, the improvement wherein the feeding point to one of the electrodes and that to another of the electrodes are located at diagonal positions relative to the parallelogram formed by the two electrodes and the outermost two of the resistance elements to form a heat-generating unit, and a plurality of the heat-generating units are connected in series at the feeding points to form a set of band-form, heat-generating apparatus; and (2) a band-form, electrically heat-generating apparatus according to the above item (1) wherein between the two electrodes of the heat-generating tape unit, or between adjacent ends of the electrodes of adjacent heat-generating tape units and having no feeding point located there, (1) at least one of (a) a voltmeter, (b) a relay for detecting abnormalities of voltage and (c) a relay for short-circuiting these electrodes when the resistance elements have been damaged is provided, or (2) terminals capable of connecting at least one of the above (a), (b) and (c) are provided for a while.

DETAILED DESCRIPTION OF THE INVENTION

The above-mentioned band-form, electrically heat-generating apparatus having two parallel electrodes and resistance elements intervened therebetween over the entire length of the eletrodes and connected thereto in parallel includes the above-mentioned known heating tapes, but they are not limited thereto. A concrete preparation example of the above-mentioned band-form, electrically heat-generating apparatus wherein a number of metallic thin wires as resistance elements are in parallel and dispersedly connected to two parallel electrodes over the entire length thereof as is shown in FIG. 15:

non-insulated local parts 51 are alternately formed at definite gaps on each of two parallel insulated wires 50, 50', and these two wires are collectively wound in helical form by a resistance wire 2, wherein the resistance wire 2 contacts the non-insulated parts 51 with portions of the wire 2 which come across the parts, and further the outer periphery of the resulting material is covered by an insulating material 52. 1, 1' are each electrodes, 8', 8'' are each heat-generating units and 15 is a gap hereinafter described.

Figure 2:
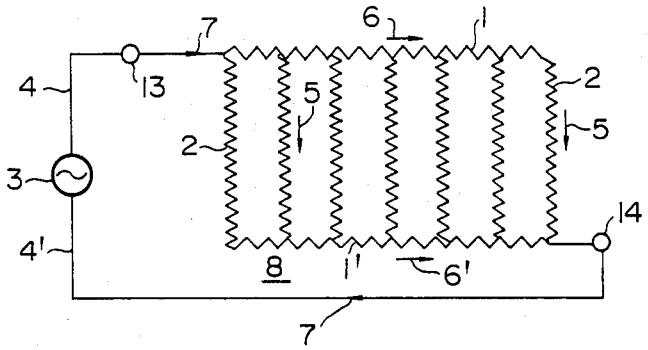
FIG. 2 shows a view illustrating the circuit in principle, of a heating tape (a band-form, electrically heat-generating apparatus mentioned later) of the present invention.

The electricity-feeding system of the heating tape of the present invention shown in FIG. 2 will be further explained in comparison with that of a known heating tape shown in FIG. 1.

In FIG. 1, currents 5 flowing through resistance elements 2 are totally summed up at electrodes 1, 1' at their passages; hence as the current approaches electric source 3, currents 6, 6' flowing through electrodes 1, 1' increase gradually. Total current 7 flows through lead wires 4, 4'. When this current is $I_0$ and the voltage of electric source 3 is $V_0$, the total input to this heating tape is $V_0I_0$ on the presumption that the impedance of the circuit consists only of pure resistance. However, according to the above-mentioned data as to the heat generation per unit length of the tape, the heat on the side of the electric source is larger by 50% than the heat at the remote end of the tape.

Figure 4:
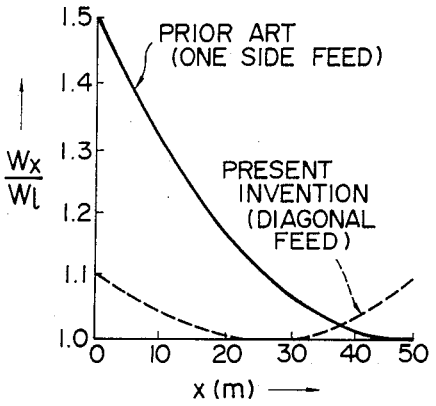

Whereas, in the case shown in FIG. 2 (the present invention), since two electrode terminals 13, 14 are diagonally provided at different ends from each other relative to the length direction of the tape, the fact that current 6 flowing through electrode 1 decreases as it becomes remote from the electric source is the same as in the above case of FIG. 1, but unlike the case of FIG. 1, current 6' flowing through electrode 1' gradually increases by summing up currents 5 flowing through resistance elements 2 toward the right, and ultimately constitutes the total current 7 i.e. $I_0$. Thus, the voltage impressed to the resistance elements 2, i.e. the voltage between electrodes $V_x$ (suffix x represents a V value at a distance x (m) from one end of the heating tape close to its electric source) reaches a maximum value at both the ends, as shown by dotted line in FIG. 3, and indicates a minimum value at the central part, but the difference is only about 3% under the same conditions as in the case of FIG. 1. Thus, generated heats $W_x$ (this suffix x also has the same meaning as above) per unit length have a difference of about 10% as shown by dotted line in FIG. 4 which difference falls in the usual allowable range. In FIGS. 3 and 4, x (m) represents a distance from one end of the heating tape close to its electric source, $V_0$ represents $V_x$ at $x=0$ and Wl represents the minimum value of $W_x$.

In order to make the difference of heat generation in the circuit of FIG. 1 (known example) about 10% as in the above example of the present invention, the length of the heating tape must be made about 23 m which is a half of 50 m. Namely according to the present invention, when the allowable difference of heat generation is 10%, it is possible to double the length of the heating tape per one unit.

The fact that it is possible to make the length of the heating tape per one unit larger as above makes it possible to reduce the number of feeding points as much in the case of a long pipeline; hence this not only contributes to economy of installations for power distribution, but makes easy the maintenance and control of the system.

The foregoing description has been made in principle; thus for example, since lead wire 4' in FIG. 2 (present invention) is longer than that in FIG. 1 (known example), the former case appears uneconomical as compared with the latter case, but this does not raise a problem when the tape is practically applied, as apparent from FIGS. 5 and 6 illustrating the cases of practical applications.

In FIGS. 5 and 6, each numeral 8 illustrates 4 units of the band-form, electrically heat-generating apparatus of the present invention each having the basic circuit shown in FIG. 2. FIGS. 5 and 6 each show a schematic view of wire connections in the case where 4 heating tapes 8 are respectively in parallel connected through lead wires 4, 4' to feeders 10, 10' or 10, 10', 10'', which are connected to electric source 3 of a single phase (FIG. 5) or a three-phase (FIG. 6), to heat a long pipeline 9 and maintain its temperature. FIG. 7 shows a case where 4 heating tapes 81, 82, 83 and 84 are in parallel connected to electric source 3 through lead wires 44, 44'. In this case, as shown in this figure, feeding terminals 13', 14' are provided diagonally to each other at the respective ends of both the end heating tapes 81 and 84 among the four, to constitute as a whole, one electrically heat-generating body 8 of the present invention. The wire connections in FIG. 7 may be suitable for heating and temperature-maintenance of a body having a broad surface (not shown).

In the case of a long pipeline, a heating power per m of 100 W or more is sometimes required. On the other hand, the output per one unit of heat-generating bodies such as the above heating tape is usually at most several tens W/m. Thus, in this case, a heat-generating body as a whole 8 as shown in FIG. 7 may be provided at the location of one unit of the heat-generating tape 8 as shown in FIG. 5 or FIG. 6. In this case, on the assumption that the heating tape 8 generates heat of 20 W/m, heat of 80 W/m will be generated.

FIG. 8 shows a band-form, electrically heat-generating apparatus wherein a plurality (4 units in the figure) of heat-generating tape units (a band-form, electrically heat-generating body having its feeding points located diagonally) are connected in series at the respective feeding points to construct a combined band-form, electrically heat-generating body, and terminals are provided at the respective feeding points located at both the ends of the combined body. In this figure, numerals 8', 8'', 8''', 8'''' each represent one heat-generating tape unit, 23, 24, 23', 24', 23'', 24'', 23''' and 24''' each represent a feeding point, and 23 and 24''' each simultaneously represent a feeding terminal. Numeral 4'(4) represents a lead wire, which means a lead wire 4', relative to the unit on the left side, and means a lead wire 4, relative to the right side. When such a combination is employed, the heat generation of the tape becomes more uniform in the length direction. This fact will be described below in more details.

For example, on the assumption that the heating tape units of the present invention each have the same material and length (50 m) as those in the cases of FIGS. 3 and 4, if a pipeline having a total length of 200 m is attempted to be heated, and when 4 heating tape units 8', 8'', 8''' and 8'''' as shown in FIG. 8 are used therefor, the unevenness of heat generation will remain 10%. In this case, however, since 4 heat-generating tape units are connected in series, the voltage between terminals 23 and 24''' amounts to about 4 times the voltage between electrodes 1 and 1', that is, if the latter voltage is 100 V, the former amounts to about 400 V.

A specific feature of heating tapes having two electrodes and electrically resistant, heat-generating bodies between the electrodes is that for example, once the voltage between electrodes is set to a commercial standard voltage of 100 V, the heating current only varies in proportion to the length of the heating tape, and unlike the case of usual heating cables wherein heat is generated by passing current through one electrically resistant wire (this heating cable is different from the above-mentioned heating cable having the same circuit in principle as that of heating tapes), it is unnecessary to vary the voltage in accordance with the length of heating means, that is, it is unnecessary to use a particular voltage for the transformer of electric source. Instead, in the case of the above example, if 100 V is used as the electric source voltage, it is impossible to sufficiently uniformly heat a long body having a length of several tens meters or longer, by one heating tape. In order to make this possible, it has been known that the electric source voltage may be raised. Namely in the case of the above-mentioned example, the voltage is about 400 V. However, if a heating tape as shown in FIG. 1 is used, the voltage between the electrodes must be made about 800 V in order to obtain a uniformity of heat-generation nearly equal to that in the example illustrated with regard to FIG. 8. Further, in this case, the resistance per m of the heating tape must be made about 64 times.

In order to make the heat generation per unit length constant and raise the voltage between the electrodes, if the resistant bodies used between the electrodes are metal thin wires, thinner wires must be used in order to make the resistance greater on the assumption that the material and the wire length are unchanged; if a composition of carbon powder is used as the resistant body, the quantity of the powder must be reduced or the cross-section of the resistance body must be made thinner. Further, many kinds of heating tapes must be produced depending on various application fields. Thus the life of heating tapes is shortened and their production and handling become difficult. Whereas, according to the combination shown in FIG. 8, it is possible to prolong the life of heating tapes and to reduce their kinds and yet correspond to many kinds of electric source voltages.

In the case of FIG. 8, it is possible to burden electrodes 1, 1' of heating tapes with the role of lead wires 4'(4) connecting 24 with 23', 24' with 23'', and 24'' with 23''', respectively. In this case, it is considered that lead wire 4'(4) between feeding points 24 and 23' is unified with electrode 1'; lead wire 4'(4) between 24' and 23'' is unified with electrode 1; and lead wire 4'(4) between feeding points 24'' and 23''' is integrated with electrode 1'. This is shown in FIG. 9 wherein gaps 15, 16, 17 are alternately inserted in a heating tape 85 to form heat-generating tape units 8', 8'', 8''' and 8'''' in the present invention on both the sides of the respective gaps whereby electricity is diagonally fed to all tapes 8'–8''''. In this case, it goes without saying that the opposed ends (18, 19) of electrodes 1 and the opposed ends of the resistance elements (corresponding to numeral 2 of FIG. 2) separated by gap 15 must be insulated from each other, respectively. This applies also to gaps 16 and 17. Numerals 33 and 34 represent feeding terminals.

FIG. 10 shows that when a heat-generating apparatus of the present invention consisting of an even number of units is used in folded state, short feeders are sufficient.

The foregoing illustrates cases where an electric source of single phase is used. However, the fact that even in the case of three-phase electrode, the present invention can be similarly practiced will be readily understood by persons skilled in the art, and this case belongs to the scope of the present invention. Examples of the connection of three-phase electrode are shown in FIG. 11 (three-phase, star type) and FIG. 12 (three-phase, triangular type).

It goes without saying that in FIGS. 5, 6, 11 or 12, it is possible to replace heating tape 8 by a combined heating tape shown in FIGS. 7, 8 or 9.

According to the above-mentioned device, almost without altering the structure of heating tapes, but merely by altering their connections to thereby modify the electricity-feeding system, it is possible to notably make the heat generation uniform or to lengthen the heating tapes per one unit to thereby reduce the number of electricity-feeding installations.

In the case of self-controllable heating tapes, heat generation occurs at the electrode part and at the part of the resistance elements having a self-controllability, and since the electrode part consists of a metal wire such as copper wire, it has no self-controllability. However, when the present invention is applied to such heating tapes, it is possible to reduce the voltage drop i.e. heat generation at the electrode part and increase the heat generation at the self-controllable heat-generating part, to thereby obtain a better self-controllability.

Now, turning to the heating tapes of FIGS. 1 and 2, one of the specific features thereof is that even if a part of resistance elements between electrodes, for example, a part (0.5 m) of the tapes having a total length of 50 m, should have caused breaking of wire or should have been damaged, so that the part generates no heat, the voltage between the electrodes is almost unchanged and heat generation at other parts is scarcely affected; and even if such a local incapability of generating heat should have occurred, it scarcely occurs that bodies to be heated such as pipelines are practically inoperatable.

However, in the heat-generating apparatus shown in FIG. 13 (its principle being the same as in the case of FIG. 8), if an abnormality such as damage or breaking of wire (47) should have occurred at a part of the resistance material or resistance wire 2 of heating tapes 8', the resistance between the electrodes of heating tapes 8' naturally increases, but a resistance relative to a number of heating tape units 8', 8'', 8''' ---, i.e. the total resistance between electrode terminals 35, 36 is not changed so much; hence the total current i.e. a current flowing through connecting wires 4, 4' is not changed so much. Thus, the current flowing through the part of damage or breaking of wire 47 flows, in turn, through another sound part 48; hence there is a fear that the temperature at the other part 48 rises. Even if the length of the part of the initial breaking of wire 47 is 0.5 m as described above, if the temperature of the other part 48 rises, the life of the part 48 is further shortened and the part of breaking of wire or damage spreads. There is a danger that this phenomenon is accelerated with the increase of lapse of time.

In the present invention, the apparatus previously described as a second main aspect thereof (2) makes it possible to early detect the above obstacle parts 47 (parts of damage or breaking of wire) when they occurred, and protect the extension of the obstacles.

One of the embodiments therefor is to provide, as shown in FIG. 14, a protective relay 37 or 38, 38' at the gap part between heat-generating tape units 8', 8'', 8'''---, etc. connected in series. For example, protective relay 37 is connected by wire 44 to terminals 39, 40 provided between heating tape units 8, 8'.

Thus, if four heat-generating tape units 8', 8'', 8''', etc. are connected in series and the voltage between electrodes 35, 36 is 400 V, the respective voltages between electrodes 1, 1', 1'', 1''' are nearly 100 V in the absence of damage or breaking of wire; hence the voltage between terminals 39, 40 i.e. the voltage applied to relay 37 is nearly 200 V. However, if an abnormality such as damage or breaking of wire 47 should have occurred, the voltage between electrodes 1, 1' exceeds 100 V and hence the voltage applied to relay 37 also rises. Thus relay 37 is actuated based on the voltage abnormality, for example, an alarm is given whereby it is possible to detect the breaking of wire or other abnormalities 47. Relay 37 of FIG. 14 illustrates a case where terminals 39, 40 of adjacent tape units are connected. Alternatively, however, as shown by relays 38, 38', relays may be taken out of the gap between electrodes 1', 1'' and electrodes 1'', 1''' of the respective heat-generating tape units. Namely, it is possible to take the respective relays out of the gap between terminals 41, 43 and 43, 42, respectively and connect them by connecting wires 45, 45', 46. When relays 38, 38' are actuated based on the voltage difference between both the electrodes in the respective heat-generating tape units, as described above, detection will be more correct than that in the case of relay 37.

As to the actuation of relays 37, 38, 38', in addition to the above function of alarming the abnormal distribution of voltage, it is also possible to impart to the relays a function of effecting short-circuiting between terminals 39, 40 in the case of relay 37, when there is an abnormality such as breaking of wire 47 in the heating tape 8', or between terminals 41, 43 and 42, 43 in the case of relays 38, 38'. In this case, the heat generation of heat-generating tape units 8', 8'' becomes zero. Further, short-circuiting may also be effected between electrodes 1, 1' with relay 38. In this case, the generated heat of tape unit 8' becomes zero. Anyhow, when protective relays are provided between adjacent terminals 39, 40 at a gap 15 located therebetween or between both the electrode terminals of heat-generating tape units (i.e. between 41, 43 and between 43, 42), it is possible to prevent extension of accidents due to breaking of wire or damage of resistance wires or filled resistance materials 2 between the electrodes. It goes without saying that relays 37, 38 and 38' become voltmeters. When such voltmeters are placed, it is of course possible to find out abnormality of voltage.

Gaps 15, 16, etc. named above are for convenience's sake, and they mean that one of the electrodes or resistance wires or resistance materials of adjacent heat-generating tape units are electrically cut off at the parts.

Further, it is not always necessary to always provide the abnormality-detecting and -protective relays 37, 38, 38', etc., but in some cases it may be sufficient that voltage is measured between these terminals several times a year or relays are provided for a while for testing. In such a case, it is sufficient that terminals 39, 40, 41, 42, 43, etc. are provided, and if abnormalities should have occurred, the presence of these terminals makes easy the detection of a location where abnormalities occurred. For example, if a pipeline to be heated has a length of 500 m or longer and the heating tape units 8', 8'', etc. each have a length of 50 m, it is possible to detect the location of an abnormality point with a precision in the range of 50 m, and also to economize the time and materials for repair.

Explanation will be unnecessary as to the fact that according to such a mere one-side feed system as known heating tapes shown in FIG. 1, the foregoing is impossible.

In the above description, damage 47 has been explained referring to the case of breaking of wire, since damage has usually been limited almost to breaking of wire. However, even if the damage is of short-circuit, a voltage abnormality, of course, occurs between terminals 39, 40 or 41, 43 or 42, 43. It is possible for the present invention to detect such an abnormality. The present invention also comprises this detection.

What we claim is:

1. A plurality of band-form electrical heat generating units connected in series (a) each band-form, electrical heat-generating unit having:

(1) two parallel electrodes, each of which is in a form of wire having a cross-sectional area of 1 to 5 $mm^2$ and has a length of several meters to several decameters, and an interval therebetween of several mm to several cm, (2) a plurality of separate resistance units extending between said two parallel electrodes over the length of the electrodes so that a parallelogram is formed by said two electrodes and the outermost two of said resistance elements, and (3) an electrical feeding point on each electrode, said feeding points being located diagonally with respect to each other on said parallelogram formed by said two electrodes and the outermost two of said resistance elements, and (b) electrical means which connect each band-form electrical heat generating unit in series with the next adjacent band-form electrical heat-generating unit at the adjacent electrical feeding points.

2. A plurality of band-form electrical heat-generating units according to claim 1 wherein a voltmeter is connected between the two electrodes of each of the heat-generating units.

3. A plurality of band-form electrical heat-generating units according to claim 1 wherein a protective relay is connected between the two electrodes of each of the heat generating units.

4. A plurality of band-form electrical heat-generating units according to claim 1 wherein a voltmeter is connected between adjacent electrodes of adjacent units at the corners of the adjacent parallelograms to which no electrical feeding point is located.

5. A plurality of band-form electrical heat-generating units according to claim 1 wherein a protective relay is connected between adjacent electrodes of adjacent units at the corners of the adjacent parallelograms to which no electrical feeding point is located.

6. A plurality of band-form electrical heat-generating units according to claim 1 wherein terminals, capable of connecting a voltmeter, are provided on the two electrodes of each of the heat-generating units.

7. A plurality of band-form electrical heat-generating units according to claim 1 wherein terminals, capable of connecting a protective relay, are provided on the two electrodes of each of the heat-generating units.

8. A plurality of band-form electrical heat-generating units according to claim 1 wherein terminals, capable of connecting a protective relay, are provided on adjacent electrodes of adjacent units at the corners of the adjacent parallelograms to which no electrical feeding point is located.

9. A plurality of band-form electrical heat-generating units according to claim 1 wherein terminals, capable of connecting a voltmeter, are provided on adjacent parallelograms to which no electrical feeding point is located.

10. A plurality of band-form electrical heat-generating units according to claim 1 wherein each of said electrodes has a length of several meters to 50 decameters and an interval therebetween in the range of several mm to several cm.

* * * * *